US006832702B2

(12) United States Patent
Garcia

(10) Patent No.: US 6,832,702 B2
(45) Date of Patent: Dec. 21, 2004

(54) FLUID DISPENSER

(75) Inventor: Firmin Garcia, Evreux (FR)

(73) Assignee: Valois S.A.S., Le Neubourg (FR)

( * ) Notice: Subject to any disclaimer, the term of this patent is extended or adjusted under 35 U.S.C. 154(b) by 77 days.

(21) Appl. No.: 10/170,569

(22) Filed: Jun. 14, 2002

(65) Prior Publication Data

US 2002/0195167 A1 Dec. 26, 2002

(30) Foreign Application Priority Data

Jun. 14, 2001 (FR) ..... 01 07801

(51) Int. Cl.[7] ..... B67D 5/06

(52) U.S. Cl. ..... 222/183; 222/321.7; 222/325; 222/402.13

(58) Field of Search ..... 222/183, 321.7, 222/321.8, 321.9, 325, 380, 402.13

(56) References Cited

U.S. PATENT DOCUMENTS 3,128,916 A * 4/1964 Picot ..... 222/183
6,073,805 A * 6/2000 Gueret ..... 222/95
6,138,870 A * 10/2000 Lin ..... 222/78
6,321,952 B1 * 11/2001 Cassier et al. ..... 222/505

FOREIGN PATENT DOCUMENTS

| | | |
|---|---|---|
| FR | 2 673 608 | 9/1992 |
| GB | 1005768 | 9/1965 |

* cited by examiner

*Primary Examiner*—Joseph A. Kaufman
(74) *Attorney, Agent, or Firm*—Sughrue Mion, PLLC

(57) ABSTRACT

A fluid dispenser, including: a receptacle defining a fluid reservoir and an opening; a dispensing member fitted in the opening of the receptacle, and provided with an actuating rod, and a pusher serving to be fitted to the actuating rod of the dispensing member. A trim shell is provided in which an assembly made up of the receptacle and of its dispensing member is adapted to be held in removable manner, and in that the pusher is held captive by the trim shell so that the actuating rod can be connected to the pusher only when inside the trim shell.

9 Claims, 2 Drawing Sheets

FLUID DISPENSER

The present invention relates to a fluid dispenser including a receptacle defining a fluid reservoir and an opening. A dispensing member such as a pump or a valve is fitted in the opening of the receptacle, and is provided with an actuating rod. A pusher is fitted onto the actuating rod of the dispensing member so that, by pressing on the pusher, the dispensing member is actuated and a metered quantity or "dose" of fluid is dispensed. This is an entirely conventional design for a dispensing member such as a pump or a valve used, for example, in the fields of perfumes, cosmetics, or indeed pharmaceuticals.

BACKGROUND OF THE INVENTION

In certain cases, the assembly made up of the receptacle, of the dispensing member, and of the pusher is received in a trim shell which may be in the form of a sheath whose appearance is pleasing. The assembly thus defined constitutes a sort of replaceable refill while the trim shell of pleasing appearance is kept to receive the new assemblies. That type of dispenser is used in particular in the fields of perfumes or of cosmetics, in which the appearance of the dispenser is of major importance. The trim shell can then have complex shapes and use precious or costly materials so that the cost of the trim shell represents a considerable proportion of the overall cost of the dispenser. It is then advantageous to be able to keep the trim shell and to replace only the assembly made up of the receptacle, of the dispensing member, and of the pusher. Since the dispensing member and the pusher are fully masked by the trim shell, they do not need to be of particularly pleasing appearance. Their cost can thus be considerably reduced.

A drawback with that type of dispenser clad with trim is that the assembly constituted by the receptacle, by the dispensing member, and by the pusher can be used without the trim shell. As a result, it is possible to purchase an assembly as thus defined without purchasing the costly trim shell. That is detrimental not only economically but also in terms of brand image which is very important for perfume manufacturers.

Document FR-1 005 768 describes a dispenser having a trim shell which is constituted by a sheath and by a cap, and which receives a refill in the form of an non-disassemblable assembly constituted by a receptacle, by a dispensing member, and by a dispensing head or pusher. That assembly is protected inside a tamper-proof jacket. The bottom of that jacket is provided with an opening for passing a stud formed at the bottom of the trim shell. In that way, once the jacket has been inserted into the trim shell, by pressing on the pusher, the stud can be caused to pass through the opening in order to move the reservoir towards the pusher, thereby causing fluid to be dispensed.

It is clear from the above-mentioned document that the pusher is secured to, integral with, or held captive by the assembly that is also constituted by the receptacle and by the dispensing member. In other words, the pusher is an integral part of the refill.

OBJECT AND BRIEF SUMMARY OF THE INVENTION

An object of the present invention is to remedy that drawback of the prior art by defining a fluid dispenser whose refill (assembly) cannot be used without the trim shell.

To achieve this object, the present invention makes provision for the dispenser to be provided with a trim shell in which an assembly made up of the receptacle and of its dispensing member is adapted to be held in removable manner, and for the pusher to be held captive by the trim shell so that said actuating rod can be connected to the pusher only when inside the trim shell. Thus, the assembly or refill does not incorporate the pusher, unlike the prior art refills. Since the pusher is an element that is essential for operating the dispenser, it is not possible to use the refill or assembly without the pusher. Therefore, by making the pusher secured to or integral with the trim shell, the user is forced to associate the refill with the trim shell in order to obtain a dispenser that is usable.

According to a practical feature of the invention, the trim shell defines, at a "top" end, a passageway in which the pusher is held captive while being able to move axially. The pusher is thus guided axially and in translation so as to define a limited stroke at the two ends. The pusher can thus move only far enough to actuate the dispensing member without being disengaged from the trim shell.

In another feature of the invention, the trim shell defines a "bottom" end which is open and through which the assembly can be inserted into the shell, a separate removable bottom advantageously closing off said open end. Advantageously, the shell comprises a drum surrounding the receptacle and a band fitted to the drum and co-operating with the drum to define a space in which the pusher is free to move axially while remaining captive. Preferably, the band is connected permanently to the drum, so that the pusher cannot be extracted from the trim shell.

In another feature of the invention that can be implemented independently of the above-mentioned feature related to the pusher being captive, the dispensing member includes a body that is open at its top end, the actuating rod being situated at said open end without projecting from the body when in the rest position. Advantageously, the pusher is provided with a connection sleeve suitable for being fitted to the actuating rod by penetrating into the body of the dispensing member. Thus, it is almost impossible to fit a pusher other than the pusher of the dispenser to the actuating rod of the dispensing member. In a conventional dispenser, the actuating rod of the dispensing member projects a long way beyond the open end of the body. The pusher then has a short connection sleeve which cannot under any circumstances penetrate into the body of the dispensing member. By limiting the height of the actuating rod inside the body of the dispensing member, it is possible to prevent any conventional pusher of the prior art from being fitted. In addition, the fact that the actuating rod does not extend beyond the body of the dispensing member constitutes a safety element by making it very difficult to push in the actuating rod since it is protected by the body of the dispensing member. Untimely actuating of the dispensing member is thus totally avoided.

BRIEF DESCRIPTION OF THE DRAWINGS

The invention is described more fully below with reference to the accompanying drawings which give an embodiment of the invention by way of non-limiting example.

MORE DETAILED DESCRIPTION

Figure 1:
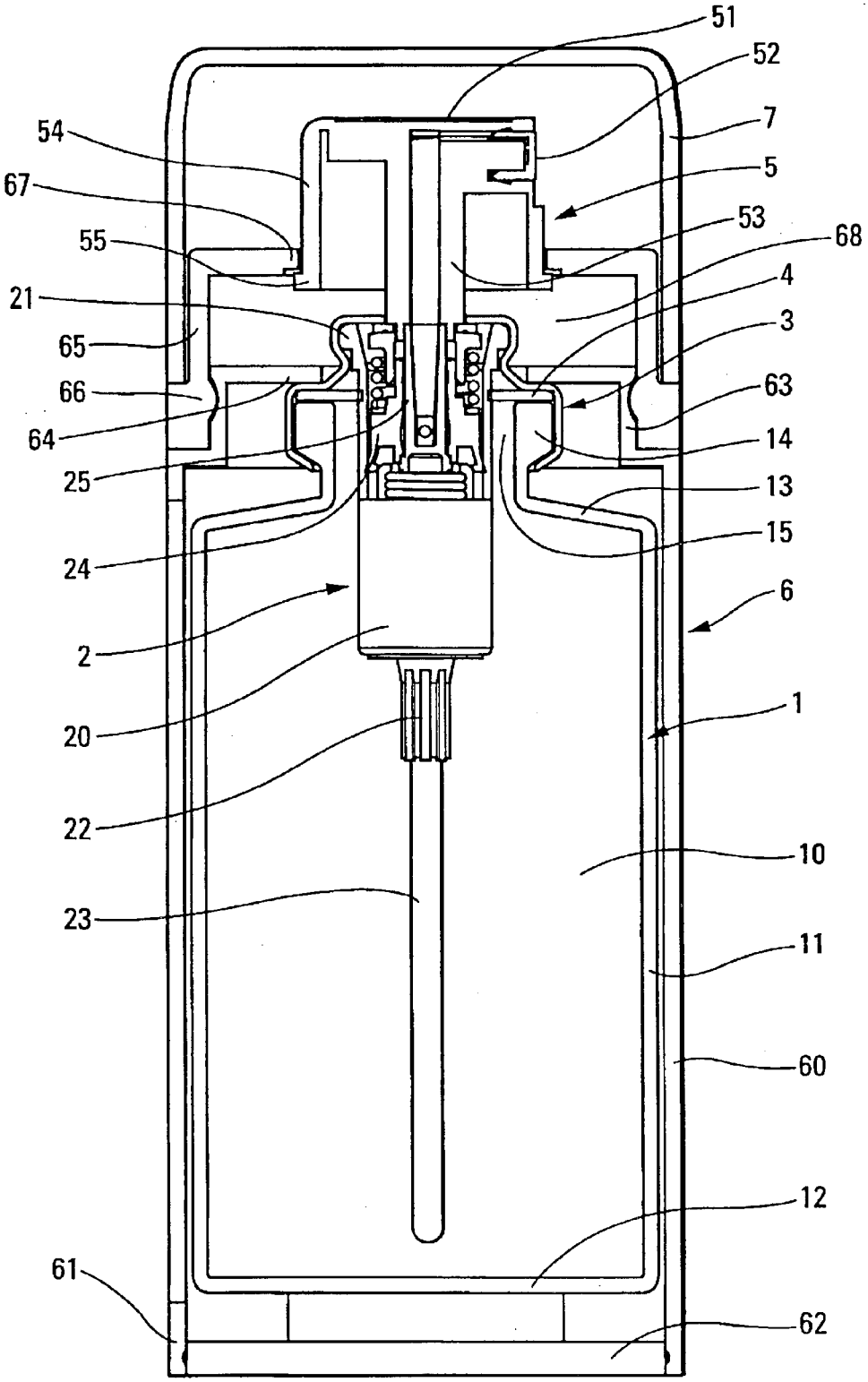
FIG. 1 is a vertical section view through a fluid dispenser of the invention.

The fluid dispenser of the invention essentially comprises four component elements, namely a receptacle 1, a dispensing member 2, a pusher 5 and a trim shell 6. The dispenser further comprises a crimping ring 3 and a neck gasket 4, but these elements may be considered as being secondary. The dispenser may also optionally further comprise a cap 7 fitted to the trim shell 6.

The receptacle 1 may be a conventional receptacle, e.g. in the form of a bottle defining a reservoir 10 serving to contain fluid, e.g. a perfume. The receptacle 1 comprises a drum 11 which may be cylindrical or optionally convex. The drum 11 is terminated at its bottom end by a bottom 12, and, at its top end, it is provided with a shoulder 13 which is terminated by a neck 14 defining an opening 15. This is an entirely conventional form of fluid dispenser receptacle.

The dispensing member 2 may be a pump or a valve. In the example shown in FIG. 1, it is a pump comprising a body 20 whose bottom end is provided with a connection sleeve 22 for connection to a dip tube 23 which extends inside the reservoir 10. The body 20 is also provided with an open top end 21 which is in crimped engagement with a crimping ring 3 which is also crimped to the body 14 of the receptacle 1. In this way, the pump 2 is fixed in the opening 15 of the receptacle 1. The pump 2 includes a piston 24 mounted to slide in leaktight manner inside the body 20 to cause the volume of the pump chamber to vary. The piston 24 is mounted on an actuating rod 25. The piston 24 is urged into its rest position by a return spring: the piston 24 then defines the maximum volume for the pump chamber. According to an advantageous feature of the invention, the top end of the actuating rod 25 does not project from the pump body 20. In other words, the actuating rod 25 lies completely within the pump body. This is clearly visible in FIG. 2 which shows the top portion of the pump in enlarged manner, with the actuating rod 25 in the extended rest position.

To be adapted to fit onto such an actuating rod 25, the pusher 5 is provided with a connection sleeve 53 that is long enough to be capable of penetrating into the pump body 20 and to be connected in leaktight manner to the free top end of the actuating rod 25. The connection sleeve 53 must also be long enough to enable the actuating rod 25 to be pushed into the pump body 20. While the actuating rod is being pushed in, the connection sleeve 53 penetrates relatively deeply into the pump body 20. This is an advantageous feature which can be implemented independently on any dispensing member. With such an actuating rod, any untimely or accidental actuating of the dispensing member is avoided since its actuating rod 25 is protected inside the pump body. In addition, this particular dispensing member accepts only a pusher that is suitably adapted to being fitted to it, such a pusher having a special connection sleeve capable of penetrating into the body 20 of the dispensing member 2.

In addition to this long connection sleeve 53, the pusher is provided conventionally with an abutment surface 51 on which the user presses to actuate the dispenser. The pusher 5 is also provided with a dispensing orifice 52 which can be in the form of a spray nozzle making it possible to obtain a sprayed jet of fluid. The pusher 5 also defines a substantially cylindrical skirt 54 which extends downwards from the abutment surface 51 while surrounding the connection sleeve 53. The skirt 54 is terminated at its free bottom end with a collar 55 which projects radially outwards and which serves as an abutment member as explained below.

Figure 2:
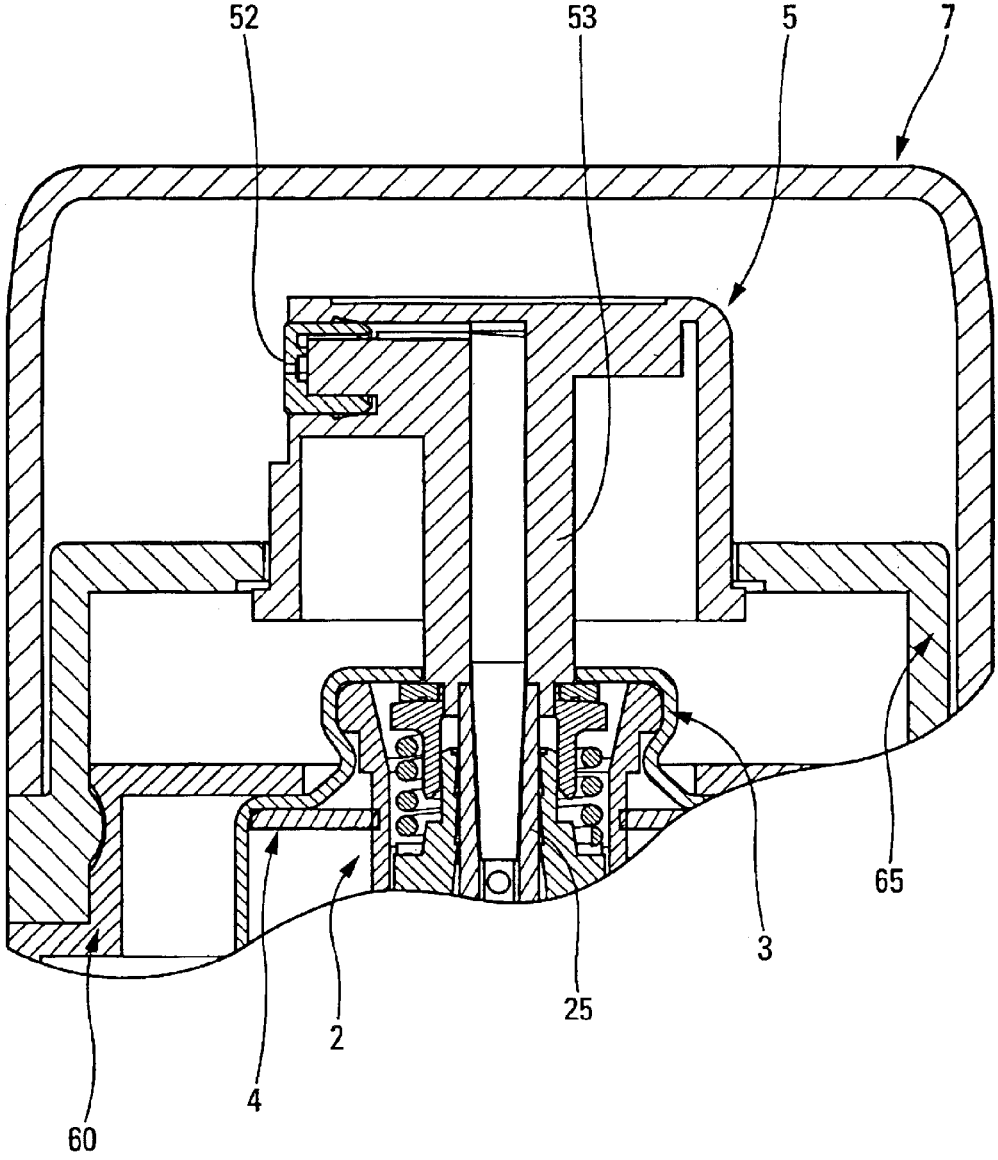
FIG. 2 is an enlarged view of the top portion of the dispenser of FIG. 1.

The trim shell 6 comprises a casing or drum 60 which surrounds the receptacle 1. At its bottom end 61, the drum 60 forms a wide opening that can be closed off by a removable separate bottom 62. The receptacle 1 is received inside the drum 60, and the removable bottom 62 may advantageously come into contact with the bottom 12 of the receptacle 1. The receptacle 1 is thus held inside the drum 60 of the trim shell 6. At its top end, the drum is extended by a snap-fastening fixing bushing 63 which is itself extended by a radial flange 64 which extends inwards and defines a central hole through which the dispensing member, or more precisely its crimping ring 3 extends. As can be seen in FIG. 1, the crimping ring 3 abuts under the radial flange 64 at the neck 14 of the receptacle 1. The remainder of the crimping ring 3 that surrounds the top end 21 of the pump body 20 extends freely through the hole formed in the center of the radial flange 64. It may be noted that the assembly formed by the receptacle 1, by the dispensing member 2, and by the crimping ring 3 constitutes a self-contained unit which is held inside the trim shell 6 entirely stably between two abutment points formed by the removable bottom 62 and the radial flange 64. The assembly defined in this way may constitute a refill that can be put in place inside the trim 6 via the bottom end 61 of the drum 60 after the removable bottom 62 has been removed. The refill can be inserted via the wide open end and brought into a final position in which the crimped top end 21 projects through the central hole in the radial flange 64, as shown in FIG. 1.

It should be noted that the refill formed by the assembly constituted by the receptacle 1 and by the dispensing member 2 does not incorporate the pusher 5. Therefore, the refill is completely unusable in the absence of the pusher 5, in particular since the actuating rod 25 is particularly short and requires a pusher that is specially adapted.

The trim shell 6 also includes a band 65 which is fitted permanently to the drum 60 by means of a permanent snap-fastening ring 66 which co-operates with the bushing 63 formed at the top end of the drum 60. At its top end, the band 65 defines a radial plateau 67 which projects inwards and which, at its center, defines a passageway through which the pusher 5 extends. The passageway defined by the plateau 67 defines an opening that is slightly wider than the skirt 54 of the pusher 5. In this way, the pusher 5 can be moved axially in translation through the passageway formed by the plateau 67. However, the collar 55 of the pusher 5 that projects radially outwards at the bottom end of the skirt 54 has a diameter that is greater than the inside diameter of the passageway so that the collar 55 comes into abutment below the plateau 67 when the pusher is moved upwards away from the dispensing member 2. This is shown precisely in FIG. 1. Furthermore, this is the rest position of the dispenser. In this way, the pusher 5 is held captive by the band 65 of the trim shell 6. The band 65 fitted on the drum 60 defines therewith an internal space 68 that communicates with the outside through the hole formed by the radial flange 64 and the passageway formed by the radial plateau 67. The pusher 5 can be moved axially in this internal space 68 without being able to exit from it. As mentioned above, the radial collar 55 prevents the pusher from being removed through the passageway formed by the plateau 67, and the opening formed by the radial flange 64 has a diameter that is considerably smaller than the diameter of the skirt 54 of the pusher 5. As a result, when in the position in which it is fully pushed into the band 65, the collar 55 comes into abutment against the radial flange 64. The pusher 5 is thus permanently held captive in the trim shell 6 since the band 65 is fitted permanently to the drum 60. It is thus not possible to extract the pusher 5 from the trim shell 6. It is free to move only in the axial direction over a limited stroke in translation via the radial flange 64 and via the radial plateau 67. In the absence of a refill, the pusher 5 rests under gravity on the radial flange 64. In this position, the connection sleeve 53 extends through the hole formed in the center of the radial flange 64. To put a refill in place, it is necessary merely to insert it via the open bottom of the drum 60, and to bring the actuating rod 25 into alignment with the axis of the connection sleeve 53 of the pusher 5. By holding the pusher 5 pressed against the radial flange 64, it is possible to connect the actuating rod 25 in leaktight manner to the connection sleeve 53. It is then necessary merely to fit the removable bottom 62 to the bottom end of the drum 60, and the dispenser is then entirely operational.

Optionally, a protective cap 7 may be fitted to the band 65 so as to come into abutment against the snap-fastening bushing 66.

By securing the pusher 5 to the trim shell, it is possible to guarantee that the refill constituted by the receptacle and by the dispensing member cannot be used without the trim shell. In addition, by shortening considerably the actuating rod of the dispensing member, any accidental actuating is avoided, and any attempt to fit a conventional pusher is prevented.

What is claimed is:

1. A fluid dispenser comprising:

a receptacle defining a fluid reservoir and an opening;

a dispensing member fitted in the opening of the receptacle, and provided with an actuating rod;

a pusher serving to be fitted to the actuating rod of the dispensing member; and a trim shell comprising a casing having an opening, the receptacle and its dispensing member forming together a refill assembly removably positioned inside the casing through the opening, the pusher held captive by the trim shell so that said actuating rod is connected to the pusher only when inside the trim shell.

2. A dispenser according to claim 1, in which the trim shell defines, at a "top" end, a passageway in which the pusher is held captive while being able to move axially.

3. A dispenser according to claim 1, in which the opening is located at a bottom end of the trim shell, a separate removable bottom advantageously closing off said open end.

4. A dispenser according to claim 1, in which the shell comprises a drum surrounding the receptacle and a band fitted to the drum and co-operating with the drum to define a space in which the pusher is free to move axially while remaining captive.

5. A dispenser according to claim 4, in which the band is connected permanently to the drum, so that the pusher cannot be extracted from the trim shell.

6. A dispenser according to claim 1, in which the dispensing member includes a body that is open at its top end, the actuating rod being situated at said open end without projecting from the body when in the rest position.

7. A dispenser according to claim 6, in which the pusher is provided with a connection sleeve suitable for being fitted to the actuating rod by penetrating into the body of the dispensing member.

8. The dispenser according to claim 1, wherein the dispensing member is a pump.

9. The dispenser according to claim 1, wherein the dispensing member is a valve.

* * * * *